US009337593B2

(12) United States Patent
Curtis et al.

(10) Patent No.: US 9,337,593 B2
(45) Date of Patent: May 10, 2016

(54) PLUG AND RECEPTACLE ASSEMBLY

(71) Applicant: Intermountain Electronics, Inc., Price, UT (US)

(72) Inventors: Dale Curtis, Castle Dale, UT (US); Shawn Norton, Price, UT (US); Tom Akers, Price, UT (US); John Houston, Price, UT (US)

(73) Assignee: INTERMOUNTAIN ELECTRONICS, INC., Price, UT (US)

( * ) Notice: Subject to any disclaimer, the term of this patent is extended or adjusted under 35 U.S.C. 154(b) by 0 days.

(21) Appl. No.: 14/304,879

(22) Filed: Jun. 13, 2014

(65) Prior Publication Data

US 2014/0370732 A1 Dec. 18, 2014

Related U.S. Application Data

(60) Provisional application No. 61/834,529, filed on Jun. 13, 2013.

(51) Int. Cl.

| | |
|---|---|
| ***H01R 24/76*** | (2011.01) |
| ***H01R 13/447*** | (2006.01) |
| ***H01R 13/73*** | (2006.01) |
| ***H01R 24/28*** | (2011.01) |

(52) U.S. Cl.

CPC ..... *H01R 24/76* (2013.01); *H01R 13/447* (2013.01); *H01R 13/73* (2013.01); *H01R 24/28* (2013.01)

(58) Field of Classification Search

USPC ..... 439/142, 141, 135, 145, 11, 701, 630; 174/50, 52; 1/1

See application file for complete search history.

(56) References Cited

U.S. PATENT DOCUMENTS

| | | | | | |
|---|---|---|---|---|---|
| 3,284,753 | A | * | 11/1966 | Goldbaum | H01R 13/62 16/386 |
| 3,750,825 | A | * | 8/1973 | Bachle | B60K 15/0406 220/324 |
| 3,887,256 | A | * | 6/1975 | Klimek | H01R 13/5221 439/142 |
| 4,061,407 | A | * | 12/1977 | Snow | H01R 13/627 439/144 |
| 4,422,706 | A | * | 12/1983 | Neuhouser | H01R 13/516 439/465 |
| 4,705,339 | A | * | 11/1987 | Hayes et al. | 439/277 |
| 4,729,741 | A | * | 3/1988 | Peng | 439/137 |
| 4,793,819 | A | * | 12/1988 | Berg | H01R 13/5227 174/67 |
| 4,946,407 | A | * | 8/1990 | Young | H01R 13/11 29/857 |
| 5,190,475 | A | * | 3/1993 | Dickens | H01R 13/516 174/138 F |
| 5,266,039 | A | * | 11/1993 | Boyer et al. | 439/107 |
| 5,272,587 | A | * | 12/1993 | Wan | 361/111 |
| 5,320,545 | A | * | 6/1994 | Brothers | 439/188 |
| 5,348,494 | A | * | 9/1994 | Falossi | H01R 13/516 439/362 |

(Continued)

OTHER PUBLICATIONS

SMC Electrical Products, SMC Electrical Connectors, Jun. 9, 1998.

(Continued)

*Primary Examiner* — Alexander Gilman
(74) *Attorney, Agent, or Firm* — Kunzler Law Group, PC

(57) ABSTRACT

According to some embodiments, an assembly includes at least one of a plug or a receptacle. The plug includes a first electrical insulator that isolates a plurality of first electrical contacts. The first electrical insulator includes two separable halves. The receptacle includes a second electrical insulator that isolates a plurality of second electrical contacts. The second electrical insulator may also include two separable halves. The plurality of first electrical contacts are engageable with the plurality of second electrical contacts to electrically couple the plug and receptacle.

13 Claims, 13 Drawing Sheets

(56) References Cited

U.S. PATENT DOCUMENTS 5,385,476 A * 1/1995 Jasper ..... H01R 13/6633 336/90
5,399,093 A * 3/1995 Schneider et al. ..... 439/21
5,417,590 A * 5/1995 Dechelette et al. ..... 439/607.48
5,429,518 A * 7/1995 Chen ..... 439/188
5,908,327 A * 6/1999 Tsuji ..... H01R 13/506 439/470
5,954,519 A * 9/1999 Hsiao ..... 439/21
5,967,815 A * 10/1999 Schlessinger et al. ..... 439/188
5,971,808 A * 10/1999 Chiang et al. ..... 439/654
5,980,313 A * 11/1999 Kunishi et al. ..... 439/545
6,004,158 A * 12/1999 Ward ..... 439/595
6,041,155 A * 3/2000 Anderson ..... G02B 6/3825 385/139
6,123,586 A * 9/2000 MacDougall ..... H01R 13/506 439/701
6,135,820 A * 10/2000 Chiang ..... 439/654
6,296,522 B1 * 10/2001 Ho ..... 439/640
6,554,150 B2 * 4/2003 Foltz ..... B60K 15/0406 220/255
6,644,984 B2 * 11/2003 Vista et al. ..... 439/76.1
6,692,305 B2 * 2/2004 Nelson ..... H01R 13/518 439/607.07
6,739,906 B2 * 5/2004 Lawrence ..... H01R 13/5216 174/93
6,753,755 B2 * 6/2004 Montague ..... 337/265
6,790,086 B1 * 9/2004 Lo ..... 439/599
6,853,289 B2 * 2/2005 Scoggin ..... 337/194
6,984,138 B2 * 1/2006 Faunce et al. ..... 439/124
7,090,509 B1 * 8/2006 Gilliland et al. ..... 439/76.1
7,160,139 B2 * 1/2007 Biermann et al. ..... 439/375
7,306,471 B2 * 12/2007 Shau-din ..... 439/171
7,422,437 B1 * 9/2008 Lin et al. ..... 439/11
7,447,043 B2 * 11/2008 Haselby et al. ..... 361/801
7,934,932 B1 * 5/2011 Lee et al. ..... 439/31
8,007,295 B2 * 8/2011 Lin ..... 439/131
8,123,528 B2 * 2/2012 Devlin et al. ..... 439/21
8,979,597 B2 * 3/2015 Starke et al. ..... 439/701
9,024,581 B2 * 5/2015 McGinley et al. ..... 320/111

OTHER PUBLICATIONS

SMC Electrical Products Components Operation, PL30DFC067-A1EX, Coupler-SMC, L/A, Plug, Line MTG, received Jun. 18, 2013.
SMC Electrical Products Components Operation, PL60DFC064-A1EX, Coupler-SMC, L/A, Plug, Line MTG, received Jun. 18, 2013.

* cited by examiner

PLUG AND RECEPTACLE ASSEMBLY

FIELD

The present application relates generally to electrical power systems and components, and more specifically to electrical plugs and receptacles that facilitate the transmission of electrical power between devices

BACKGROUND

Plug and receptacle assemblies are known in the art for facilitating the transmission of electrical power from one electrical device to another electrical device. Generally, the plug is coupled to one electrical device and is designed to be removable from the receptacle, which is coupled to another electrical device. In this manner, the plug can be inserted into the receptacle when power transfer between electrical devices is desired, and removed from the receptacle when power transfer between the electrical devices is not desired. Typical plugs and receptacles each includes mating electrical contacts surrounded by and coupled to an electrical insulator. The electrical contacts of plugs and receptacles mate with each other to facilitate the transfer of power between respective electrical devices. The electrical contacts are electrically coupled to electrical transmission components (e.g., wires or cables) of the electrical devices. The electrical insulator prevents unintended electrical shorts across non-mating electrical contacts of the plugs and receptacles.

Over time, the electrical insulator tends to degrade or wear down due to repeated insertion of the plug into the receptacle and removal of the plug from the receptacle. Often, sufficiently degraded electrical insulators require repair or replacement. Because conventional electrical insulators are coupled to the electrical contacts of the respective plug and receptacle, which themselves are electrically coupled to other electrical transmission components, the electrical contacts or electrical transmission components must be decoupled from the insulators before repair or replacement can occur. Further, for replacement insulators, the electrical contacts or electrical transmission components must be recoupled to the insulator. In this manner, repair or replacement of degraded or defective insulators requires complete disassembly and reassembly of the associated plug and receptacle, which increases safety hazards, downtime, labor, and expense.

Additionally, conventional receptacle designs employ a pivoting cover that covers the electrical contacts of the receptacle when not in use. Some covers are engageable by a user to manually open the cover from a closed position by grasping the cover and moving it into the open position. Generally, such covers are configured without an open bias. In other words, a user must manually grasp and actuate the cover along the entire path from a closed position to an open position. Because the user must grasp the cover, the operation of opening the cover requires the use of at least one hand by the user. Unfortunately, in particular industries (e.g., mining, oil and gas, etc.) that utilize relatively large plugs, both hands of a user often are required to lift and insert a plug into a receptacle. Therefore, conventional receptacle covers may require a single user to drop the plug, open the cover with at least one hand, and re-lift the plug for insertion into the receptacle. Such a process is cumbersome and time-consuming. Additionally, some unbiased covers do not maintain the cover in the open position and tend to close when opening of the cover is desired. Further, certain biased covers are intentionally biased to close even when opening of the cover is desired. Accordingly, the tendency and bias of traditional receptacle covers to close tends to make opening the cover and inserting a plug difficult due to the cover getting in the way of insertion.

Often, the receptacle is electrically coupled to the exterior of a housing of a power generation device, with the electrical contacts being exposed to an interior of the housing. One common technique for physically coupling the receptacle to the housing of the power generation device is to use mounting bolts that extend into the housing, with nuts inside the housing to secure the bolts to the housing. Typical configurations require access to the interior of the housing in order to fasten the receptacle to the housing or remove the receptacle from the housing. In view of the hazards associated with accessing an interior of a power generation device housing, the power generation device needs to be powered down in advance. Powering down the power generation device to secure or remove a receptacle results in unnecessary downtime, delays, labor, and expense.

SUMMARY

The subject matter of the present application has been developed in response to the present state of the art, and in particular, in response to the problems and needs in the electrical plug and receptacle assembly art that have not yet been fully solved by currently available plug and receptacle assemblies. For example, although known plug and receptacle assemblies may adequately accomplish the intended function of transmitting power between electrical devices, such assemblies do not provide a safe, convenient, quick, and cost-efficient way to repair or replace defective or degraded insulators, access the electrical contacts of the receptacle, and/or fasten a receptacle to a power generation housing without requiring access to an interior of the housing. Accordingly, in certain embodiments, a plug and receptacle assembly is described herein that overcomes at least the above and other shortcomings of the prior art.

According to some embodiments, an assembly includes at least one of a plug or a receptacle. The plug includes a first electrical insulator that isolates a plurality of first electrical contacts. The first electrical insulator includes two separable halves. The receptacle includes a second electrical insulator that isolates a plurality of second electrical contacts. The second electrical insulator includes two separable halves. The plurality of first electrical contacts are engageable with the plurality of second electrical contacts to electrically couple the plug and receptacle.

In some implementations, the assembly includes both the plug and the receptacle. The receptacle can be electrically coupled to a power generating device and receive power from the power generating device. The power is rated at less than or equal to 1,000 V.

According to some implementations of the assembly, each of the separable halves of the first electrical insulator includes a plurality of apertures through which the plurality of first electrical contacts extend, and each of the separable halves of the second electrical insulator includes a plurality of apertures through which the plurality of second electrical contacts extend. A first of the separable halves of the first electrical insulator can include a plurality of first alignment features each positioned about a respective one of the plurality of apertures of the first separable half of the first electrical insulator. Each of the plurality of first alignment features is received within a respective one of the plurality of apertures of a second separable half of the first electrical insulator. A first of the separable halves of the second electrical insulator includes a plurality of second alignment features each positioned about a respective one of the plurality of apertures of the first separable half of the second electrical insulator. Each of the plurality of second alignment features is received within a respective one of the plurality of apertures of a second separable half of the second electrical insulator.

In certain implementations of the assembly, each of the plurality of first alignment features nestably engages a respective one of the plurality of apertures of the second separable half of the first electrical insulator, and each of the plurality of second alignment features nestably engages a respective one of the plurality of apertures of the second separable half of the second electrical insulator. The plurality of apertures of a first of the separable halves of the first electrical insulator can be larger than the plurality of apertures of a second of the separable halves of the first electrical insulator, and the plurality of apertures of a first of the separable halves of the second electrical insulator can be larger than the plurality of apertures of a second of the separable halves of the second electrical insulator.

According to some implementations of the assembly, a first of the separable halves of the first electrical insulator includes a plurality of first protrusions and a second of the separable halves of the first electrical insulator includes a plurality of first recesses. Each of the plurality of first protrusions is received within a respective one of the plurality of first recesses. A first of the separable halves of the second electrical insulator includes a plurality of second protrusions and a second of the separable halves of the second electrical insulator includes a plurality of second recesses. Each of the plurality of second protrusions is received within a respective one of the plurality of second recesses.

In certain implementations of the assembly, the two separable halves of the first electrical insulator are rotatably fixed relative to each other, and the two separable halves of the second electrical insulator are rotatably fixed relative to each other.

According to some implementations of the assembly, a first half of the separable halves of the first electrical insulator is an interior half not accessible by the receptacle, and the second half of the separable halves of the first electrical insulator is an exterior half accessible by the receptacle. Interior portions of the plurality of first electrical contacts are electrically wired via wiring to a power cord that extends from the plug. The exterior half of the first electrical insulator is replaceable by another exterior half without replacing the interior half of the first electrical insulator, and without having to disconnect the wiring from the interior portions of the plurality of first electrical contacts.

In certain implementations, a first half of the separable halves of the second electrical insulator is an interior half not accessible by the plug and the second half of the separable halves of the second electrical insulator is an exterior half accessible by the plug. Interior portions of the plurality of second electrical contacts are electrically wired via wiring to a power center to which the receptacle is coupled. The exterior half of the second electrical insulator is replaceable by another exterior half without replacing the interior half of the second electrical insulator, without having to disconnect the wiring from the interior portions of the plurality of first electrical contacts, and without having to decouple the receptacle from the power center.

In some implementations of the assembly, each of the two separable halves of the first electrical insulator includes a base plate that has a flat surface. The flat surfaces of the base plate of the first electrical insulator abut and are flush against each other. Each of the two separable halves of the second electrical insulator includes a base plate that has a flat surface. The flat surfaces of the base plate of the second electrical insulator abut and are flush against each other.

According to some implementations of the assembly, the plug includes a housing that surrounds the first electrical insulator, and the receptacle includes a housing that surrounds the second electrical insulator. The receptacle can include a cover that is rotatable about a retention rod coupled to the plug. The cover is rotatable between a closed position covering the plurality of electrical contacts and an open position exposing the plurality of electrical contacts. The plug includes a hinge plate that engages and rotates about the retention rod.

According to certain implementations of the assembly, the two separable halves of the first electrical insulator are formed separately from each other and each form a one-piece monolithic construction. Similarly, the two separable halves of the second electrical insulator can be formed separately from each other and each can form a one-piece monolithic construction.

In another embodiment, a power center includes a wall that defines an internal space. The wall has an internal surface and external surface that opposes the internal surface. Additionally, the wall further includes a first aperture and a plurality of second apertures that are positioned about the first aperture. The power center also includes a mounting bracket that includes a plate positioned within the internal space adjacent the internal surface. A plurality of posts are coupled to the plate and extend through the plurality of second apertures. The plate defines a third aperture. The power center further includes a receptacle that includes a housing positioned adjacent the external surface. The housing is coupled to the plurality of posts. The receptacle includes at least one electrical contact that extends through the third aperture of the plate and the first aperture of the wall.

According to one implementation, the power center also includes at least one nut that secures at least one post to the wall. The at least one nut abuts the external surface. Further, the housing includes at least one receptacle for receiving the at least one nut.

According to yet another embodiment, an electrical receptacle includes a housing and an electrical contact interface coupled to the housing. The electrical receptacle also includes a cover that is movable between a closed position covering the electrical contact interface and an open position exposing the electrical contact interface. Additionally, the electrical receptacle includes a bias element that is coupled to the cover. The bias element is configured to automatically move the cover from the closed position to the open position.

In some implementations of the electrical receptacle, the bias element includes a coiled spring. The electrical receptacle may include a cover retention system that releasably retains the cover in the closed position. The cover retention system can include a foot pedal. According to one implementation, the cover retention system releasably retains an electrical plug engaged with the electrical receptacle.

The described features, structures, advantages, and/or characteristics of the subject matter of the present disclosure may be combined in any suitable manner in one or more embodiments and/or implementations. In the above description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the above description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
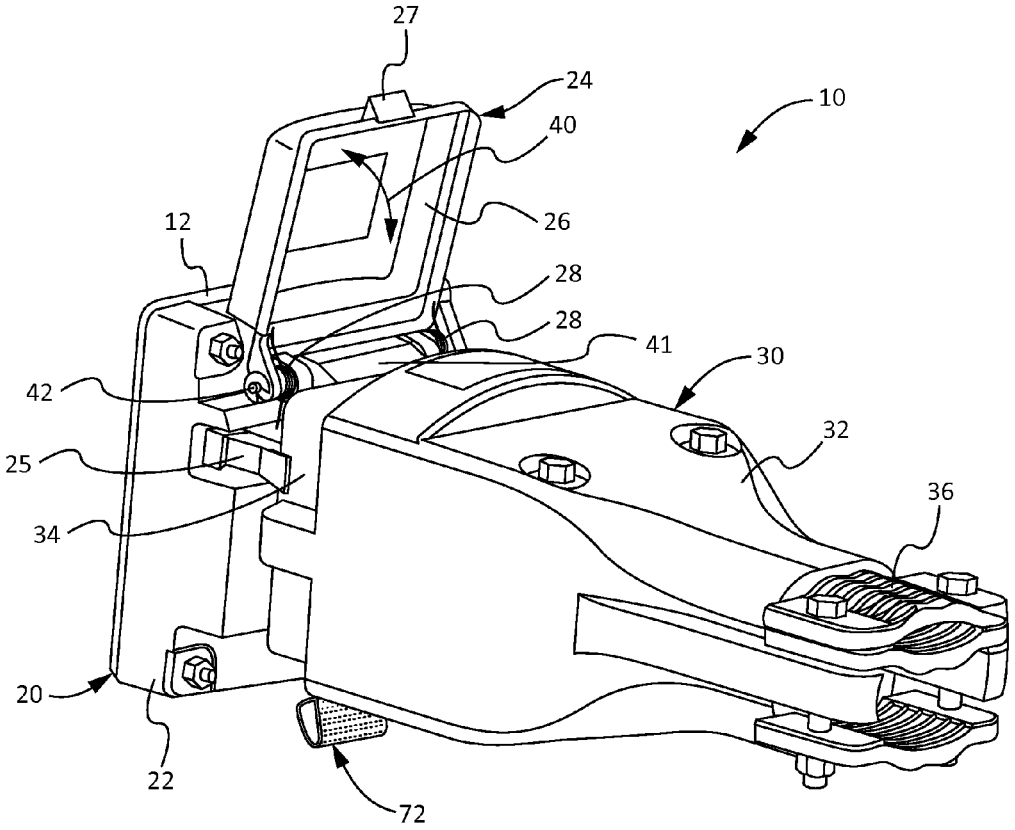
FIG. 1 is a perspective view of a plug and receptacle assembly according to one embodiment.
Figure 3:
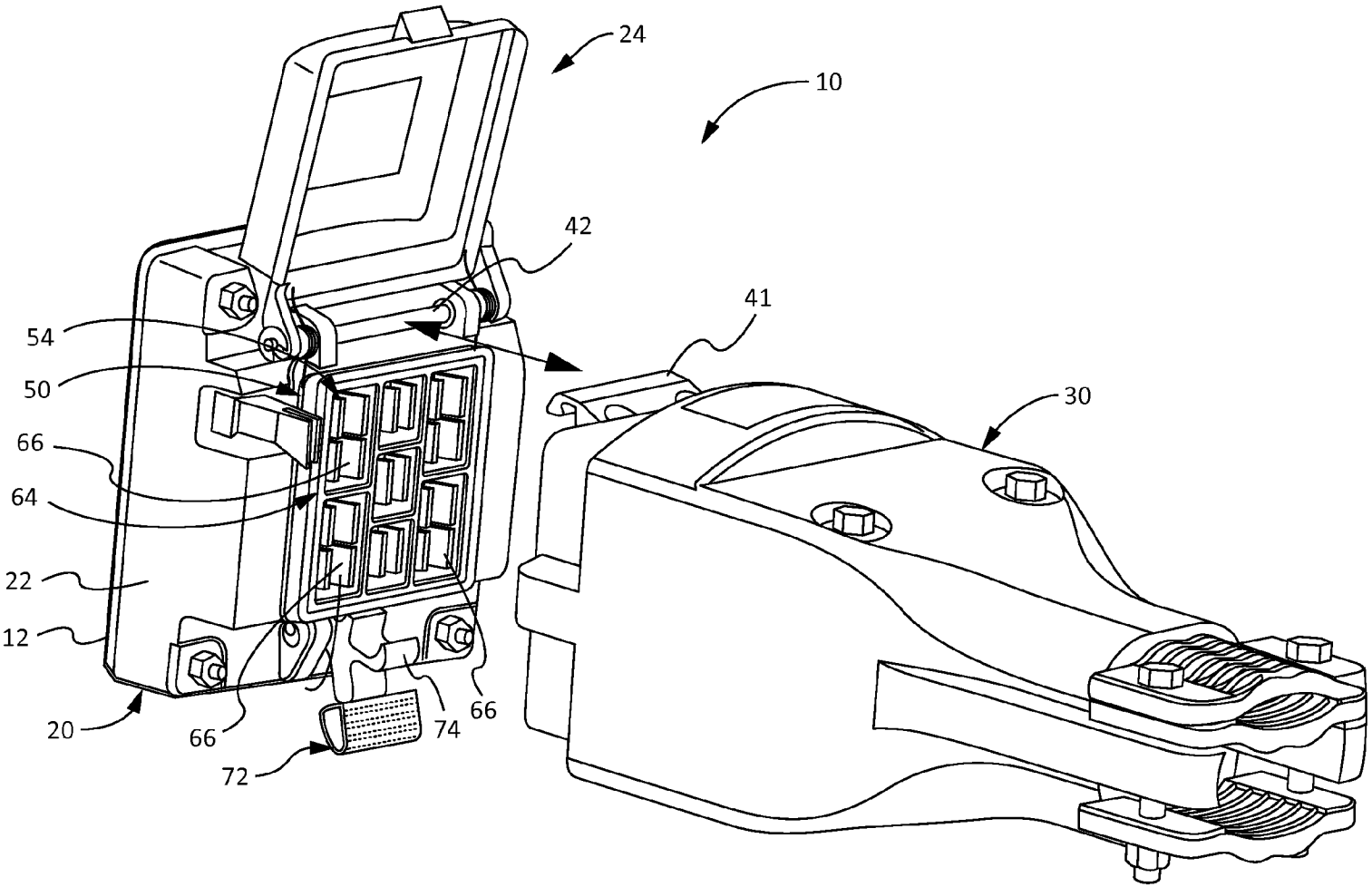
FIG. 3 is a perspective view of the plug and receptacle assembly of FIG. 1 shown with the plug decoupled from the receptacle.
Figure 4:
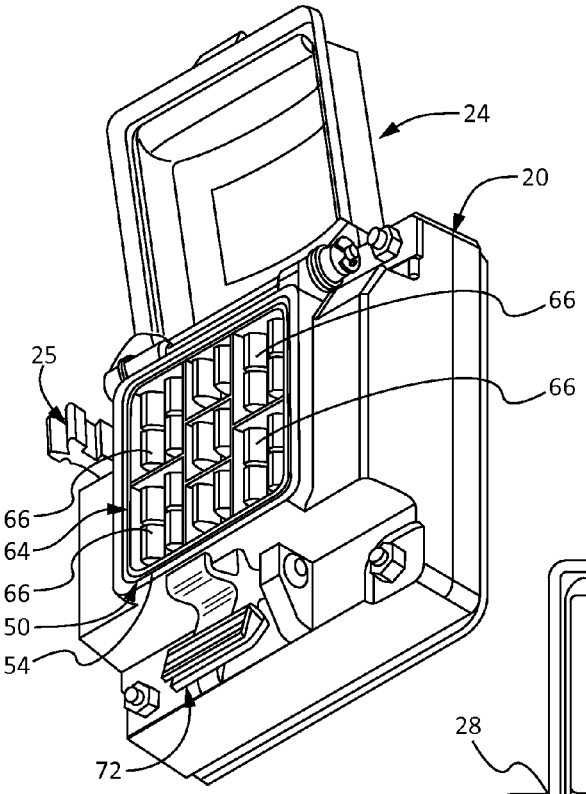
FIG. 4 is a front perspective view of a receptacle of the plug and receptacle assembly of FIG. 1.
Figure 5:
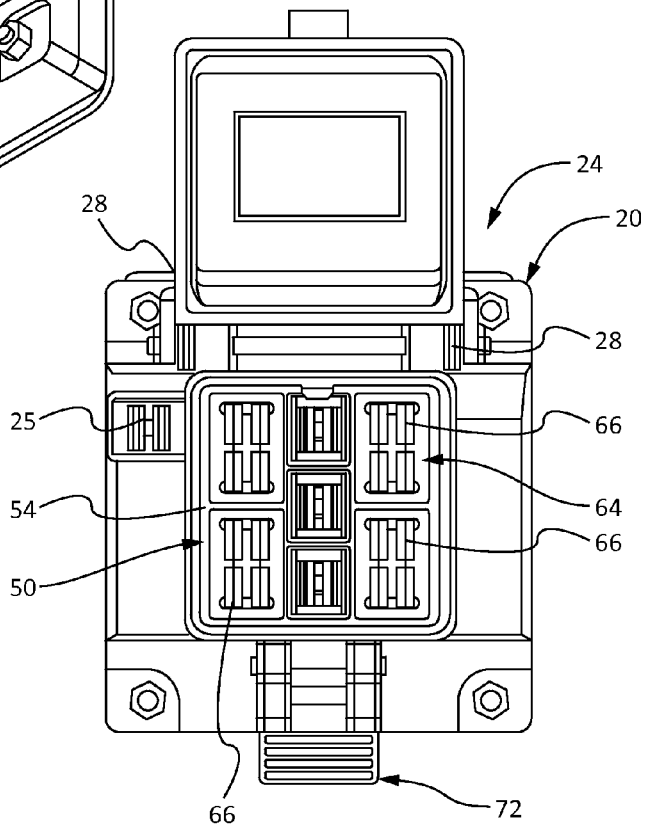
FIG. 5 is a front view of the receptacle of FIG. 4.
Figure 17:
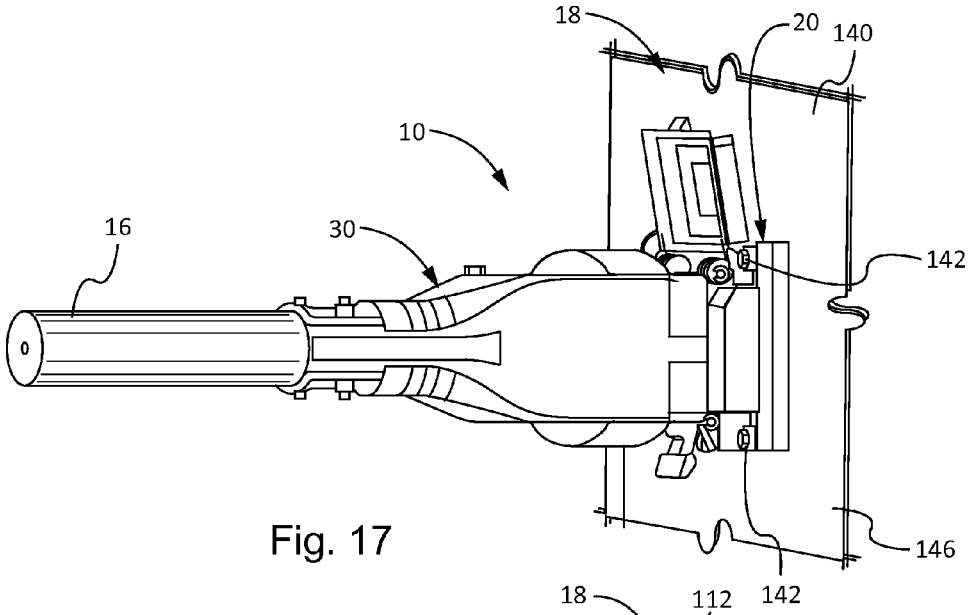
FIG. 17 is a perspective view of a plug and receptacle assembly coupled to a wall as shown from an external side of the wall according to one embodiment.
Figure 18:
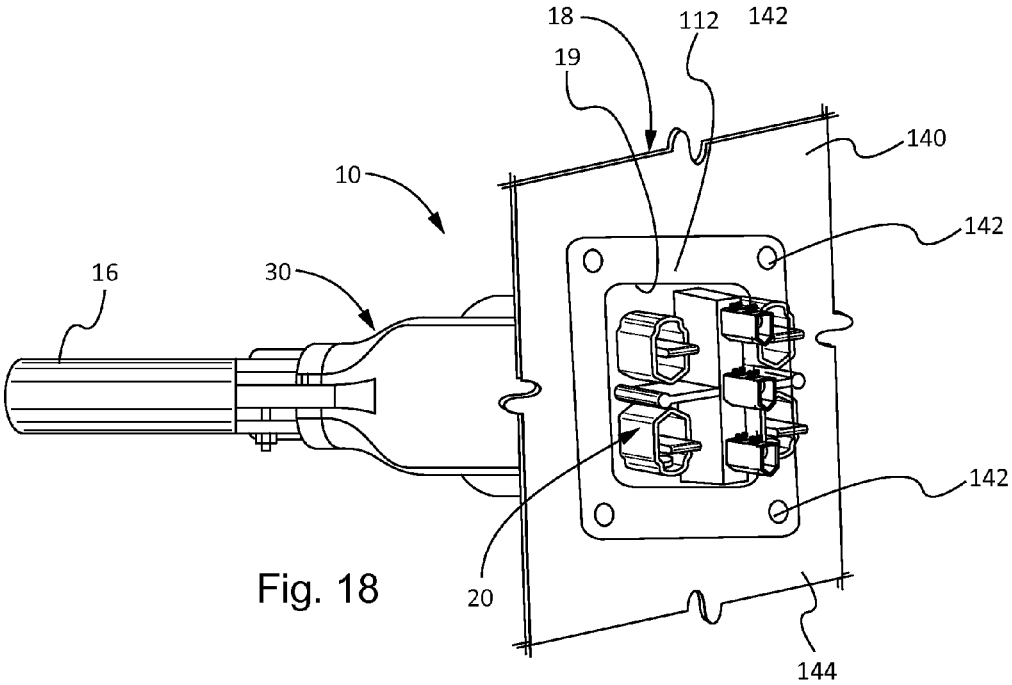
FIG. 18 is a perspective view of a plug and receptacle assembly coupled to a wall as shown from an internal side of the wall according to one embodiment.
Figure 19:
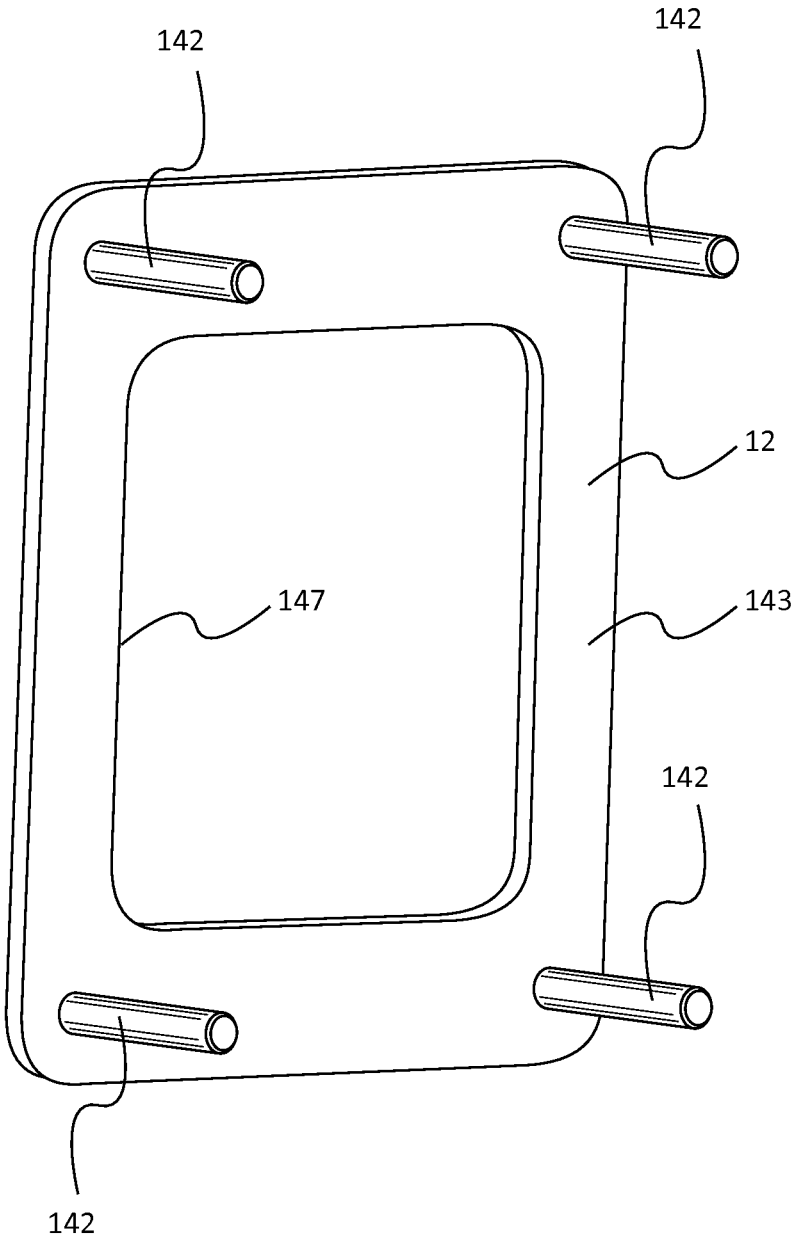
FIG. 19 is a perspective view of a mounting bracket according to one embodiment.

Referring to FIG. 1, according to one embodiment, a perspective view of a plug and receptacle assembly 10 is shown. The assembly 10 includes a receptacle 20 removably and electrically coupled to a plug 30. The receptacle 20 can form part of an electrical device 18, such as a power generating or transmission device or power center, providing a source of power to the plug 30 (see, e.g., FIGS. 17 and 18). For example, in some embodiments, the electrical device 18 is a power generating or transmission device rated at up to 1,000V of power at 300 or 600 Amps. In some implementations, the electrical device 18 is a power generating or transmission device rated above 120 V (or 240 V in certain implementations) and below, or equal to, 1,000V. The plug 30 can form part of another electrical device receiving power from the power source and be electrically coupled to an electrical wire or cable 16 that provides an electrical conduit from the plug to the electrical device receiving the power (see, e.g., FIGS. 17 and 18). In certain embodiments, the function of the receptacle 20 and plug 30 can be reversed, such that the plug provides power to the receptacle. As shown in FIG. 3, the plug 30 can be moved away from the receptacle 20 to decouple the plug and receptacle, and moved toward the receptacle to couple the plug and receptacle as shown by directional arrows.

Figure 15:
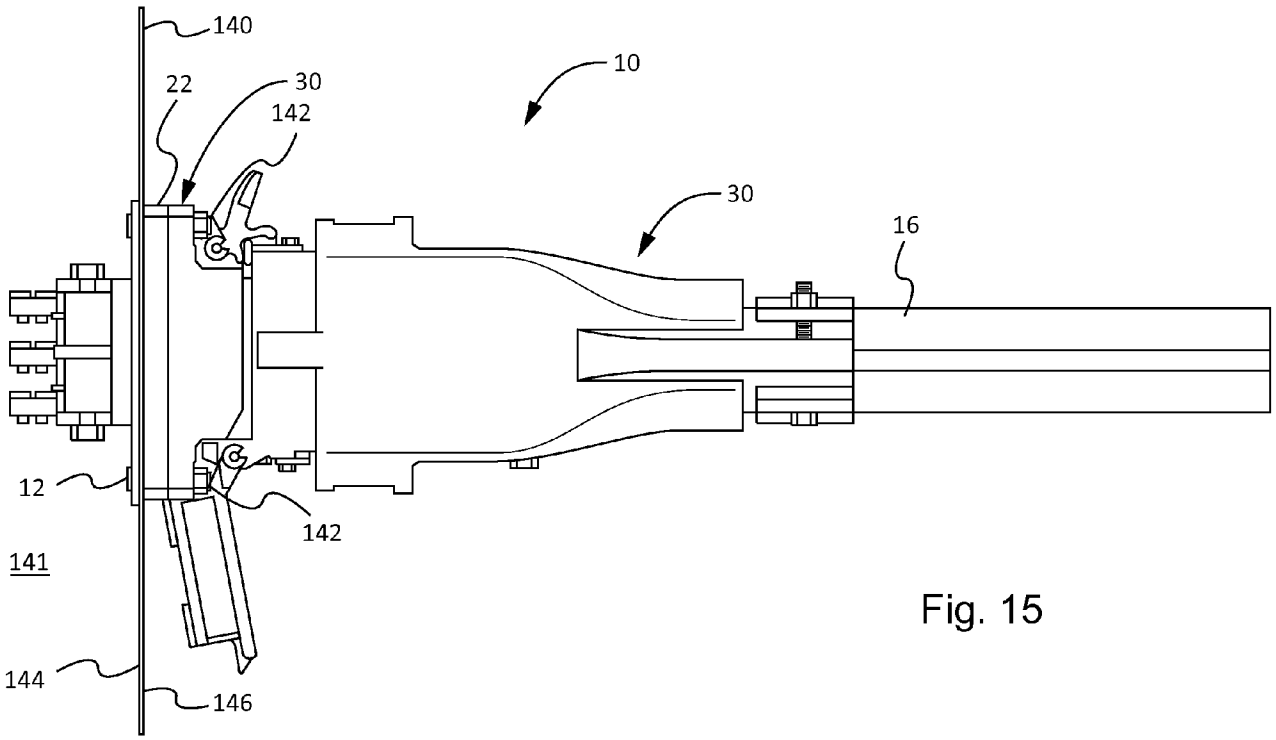
FIG. 15 is a side view of a plug and receptacle assembly coupled to a wall according to one embodiment.

Referring to FIGS. 1-5, the receptacle 20 includes a housing 22 that at least partially houses an insulator 50. The insulator 50 insulates the electrical contacts 62, 66 of internal and external electrical contact interfaces 60, 64, respectively, of the receptacle 20. Further, the housing 22 can at least partially house the external electrical contact interface 64. The electrical contacts 62 of the internal electrical contact interface 60 are electrically coupled to respective electrical terminals (not shown) of the electrical device 18. Accordingly, in the illustrated embodiment, the electrical contacts 62 are positioned within an internal space 141 defined by the electrical device 18 (see, e.g., FIG. 15). The electrical contacts 66 of the external electrical contact interface 64 can be female contacts or include female terminals for receiving male contacts or terminals of the plug 30. Alternatively, the electrical contacts 66 of the external electrical contact interface 64 can be male contacts or include male terminals for receiving female contacts or terminals of the plug.

Each electrical contact 62 of the internal interface 60 is electrically coupled to a corresponding one of the electrical contacts 66 of the external interface 64. In some implementations, electrically coupled internal and external contacts 62, 66 form a single monolithic structure made from an electrically conductive material. In other implementations, electrically coupled internal and external contacts 62, 66 are electrically coupled together by one or more electrically conductive couplings. In this manner, electrical power can be freely transmitted between electrically coupled internal and external contacts 62, 66. Accordingly, when electrically coupled to the internal electrical contacts 62, power from the electrical device 18 is transmitted to the exterior electrical contacts 66.

Because the exterior electrical contacts 66 are hot or electrically charged, and to protect the contacts from damage and debris, in certain embodiments, the external electrical contact interface 64 is coverable by a cover system 24 forming part of the housing 22 when a plug 30 is not coupled to the receptacle. The cover system 24 includes a cover 26 that is pivotably coupled to a retention rod 42 of the housing 22. The cover system 24 also includes one or more biasing elements 28 coupled to the housing 22. The biasing elements 28, which can be coiled springs, bias the cover 26 in an open position as shown in FIGS. 1-5. More specifically, the biasing elements 28 automatically urge the cover 26 from the closed position into the open position. The biasing force of the biasing elements 28 is sufficient to automatically move the cover 26 from the closed position into the open position without manual intervention. With the cover 26 in the open position, the exterior electrical contacts 66 are exposed and accessible to the plug 30.

In contrast, when the receptacle 20 is not in use, the cover 26 can be pivoted about the retention rod 42 as shown by directional arrow 40 into a closed position (not shown) covering the external electrical contact interface 64 by applying a closing force to the cover that is greater than the opening bias force of the biasing elements 28. The housing 22 may include a cover retention system to releasably retain the cover 26 in the closed position. The cover retention system can include a pedal 72 with a latch 74 designed to engage a tab 27 formed in the cover 26 when the cover is in the closed position. The pedal 72 may be biased in a direction towards the cover 26 such that the pedal and latch 74 are naturally drawn into an engagement position with the tab 27 of the cover 26. In this manner, as a user manually closes the cover 26 from the open position toward the closed position, the bias of the pedal 72 causes the latch 74 to engage the tab 27 without user manipulation of the pedal. To release the cover 26 from a closed position, the pedal 72 can be engaged (e.g., pushed) by a user in a direction opposing its biased direction to overcome the bias, move the pedal away from the cover, and disengage the tab 27 from the latch 74. Once the tab 27 of the cover 26 is disengaged from the latch 74, the force of the biasing elements 28 act to automatically open the cover without further user intervention. In this manner, with the cover 26 in the closed position, a user can grasp a plug with two hands, and use a foot to engage the latch 74 and automatically open the cover without releasing his hands from the plug.

In a similar manner, the pedal 72 and latch 74 can be biased to engage a tab 33 (see, e.g., FIG. 2) formed in the plug housing to releasably retain the plug against the receptacle while the plug is connected to the receptacle. To release the plug 30, the pedal 72 can be engaged by a user to move the pedal away from the plug and disengage the tab 33 from the latch 74. Accordingly, the pedal 72 serves the dual purpose of releasably retaining the cover 26 in a closed position when the receptacle 20 is not engaged with the plug 30, and releasably retaining the plug when the plug is engaged with the receptacle.

The external interface 64 may include an auxiliary ground terminal 25 that is not covered by the cover 26 when the receptacle 20 is not in use. The auxiliary ground terminal 25 has a corresponding internal electrical contact that is electrically coupled to the auxiliary ground terminal 25 by an electrical conduit 29 (see, e.g., FIG. 7).

In the illustrated embodiment, the receptacle 20 is secured to the electrical device 18 via a mounting bracket 12 (see, e.g., FIGS. 1-3 and 15-19). The electrical device 18 includes an aperture 19 formed in a wall 140 of the electrical device. The aperture extends from an internal surface 144 of the wall 140 to an external surface 146 of the wall. The internal electrical contact interface 60 of the receptacle 20 extends through the aperture 19, and the housing 22 of the receptacle abuts the external surface 146. Although obstructed by the mounting bracket 12, the wall 140 includes a plurality of apertures formed in the wall about the aperture 19. The size, shape, and arrangement of the plurality of apertures in the wall correspond with the size, shape, and arrangement of a plurality of posts 142 extending transversely from a base 143 of the bracket 12 (see, e.g., FIG. 19). The base 143 is a substantially flat plate defining a central aperture 147. The central aperture 147 is sized to extend about a periphery of the aperture 19 formed in the wall 140. The posts 142 can be cylindrically shaped and have external threads for receiving the internal threads of a nut or other fastener. In certain implementations, the posts 142 are fixedly secured to the base 143 via a fastening, welding, or adhesion technique. The posts 142 can be permanently or removably secured to the base 143.

Figure 16:
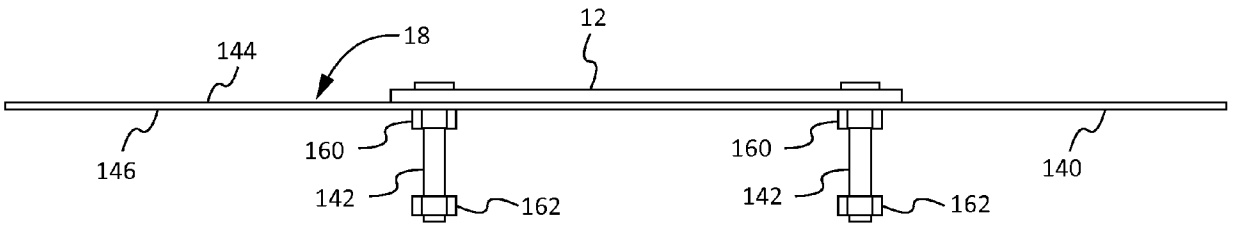
FIG. 16 is a side view of a mounting bracket coupled to a wall according to one embodiment.
Figure 20:
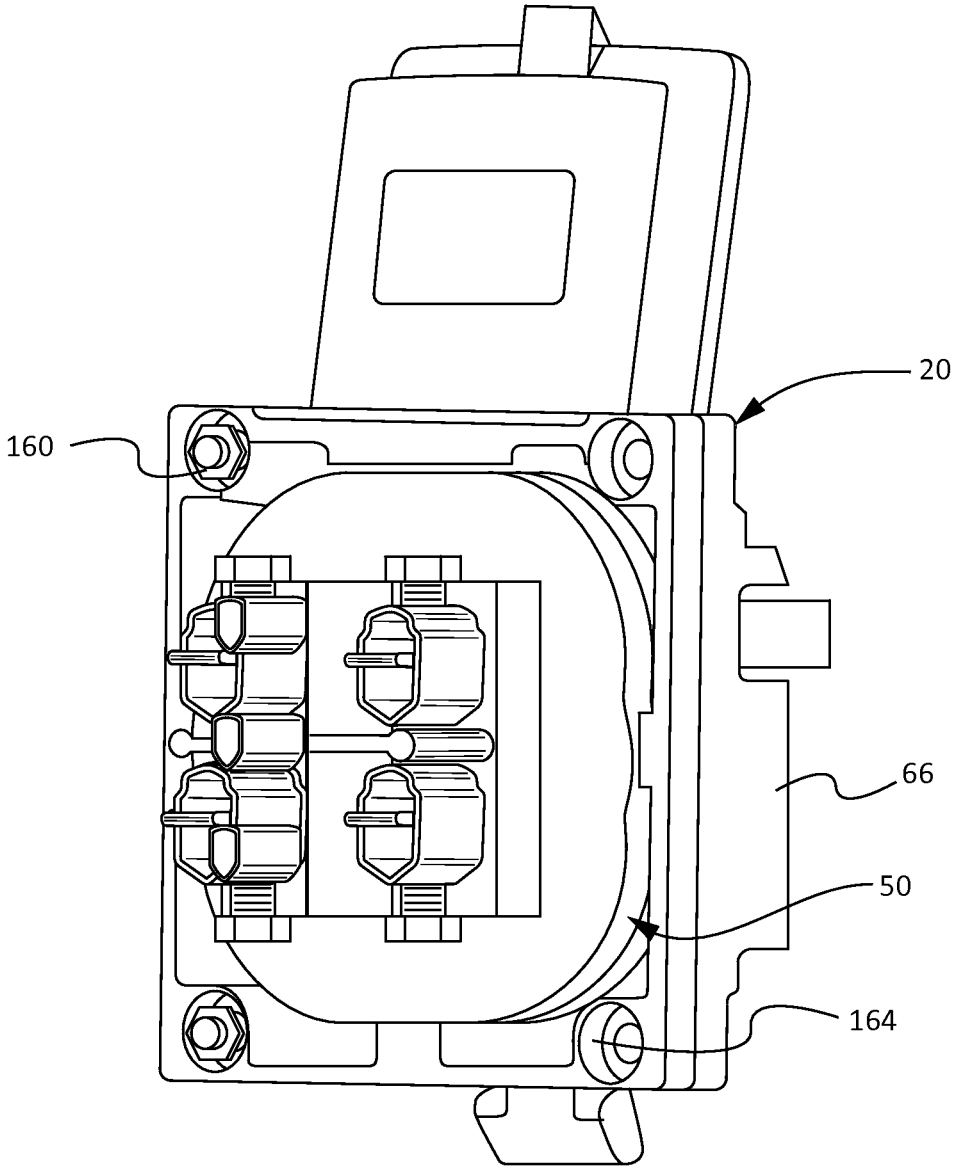
FIG. 20 is a rear perspective view of a receptacle of a plug and receptacle assembly according to one embodiment.

When assembled, the base 143 is positioned within the internal space 141 of the electrical device 18 and abuts the internal surface 144 of the wall 140. The plurality of posts 142 extend through the plurality of apertures formed in the wall 140, such that the posts are accessible externally of the electrical device 18. In some implementations, the base 143 is fixedly secured to the internal surface 144 of the wall 140 via a fastening, welding, or adhesion technique. The base 143 can be permanently or removably secured to the wall 140. As shown in FIG. 16, in some implementations, the base 143 is removably secured to the wall 140 using at least one nut 160 attached to a respective one of the posts 142. The nut 160 can be tightened against the external surface 146 of the wall 140 to tighten the base 143 against the internal surface 144 of the wall. In this manner, the mounting bracket 12 can be secured to the housing of the electrical device 18. Further, as shown in FIG. 20, the housing 22 of the receptacle 20 has at least one cavity 164 sized and positioned to receive the at least one nut 160 such that the housing can directly abut (e.g., be mounted flush against) the external surface 146 of the wall 140. Additionally, the housing 22 of the receptacle 20 has apertures that are coextensive (e.g., coaxial) with the cavities 164. These apertures are sized, shaped, and arranged to receive and engage the exposed posts 142 from outside of the electrical device 18. A fastener 162 (e.g., nut) can threadably engage the posts 142 to secure the housing 22 of the receptacle 20 against the external surface 146 of the wall 140 (see, e.g., FIG. 16). Because the mounting bracket does not require adjustment of fasteners or other components on the inside of the electrical device 18, the electrical device 18 does not need to be powered down whenever a receptacle is installed or removed from the device.

Figure 2:
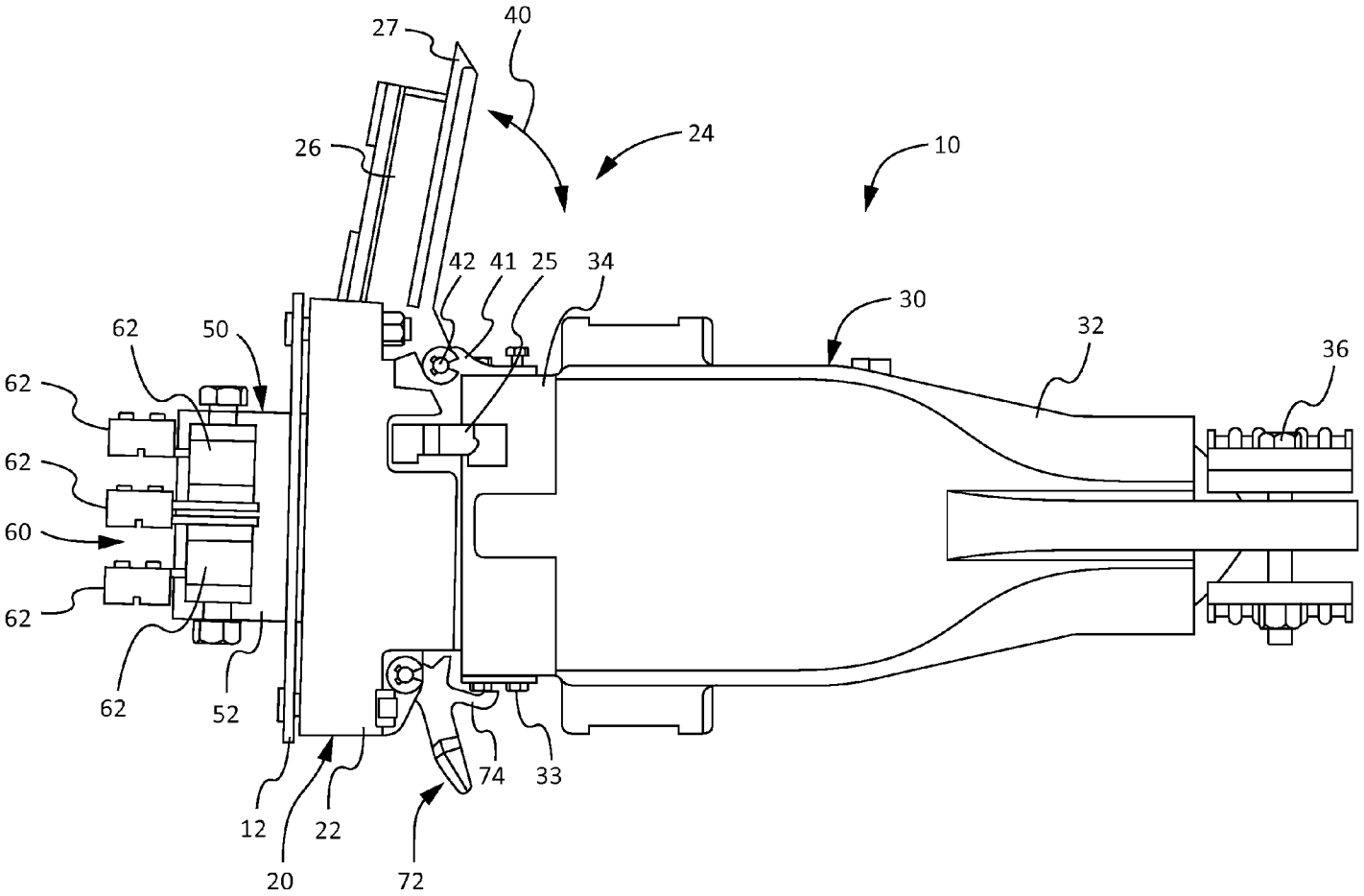
FIG. 2 is a side view of the plug and receptacle assembly of FIG. 1.
Figure 6:
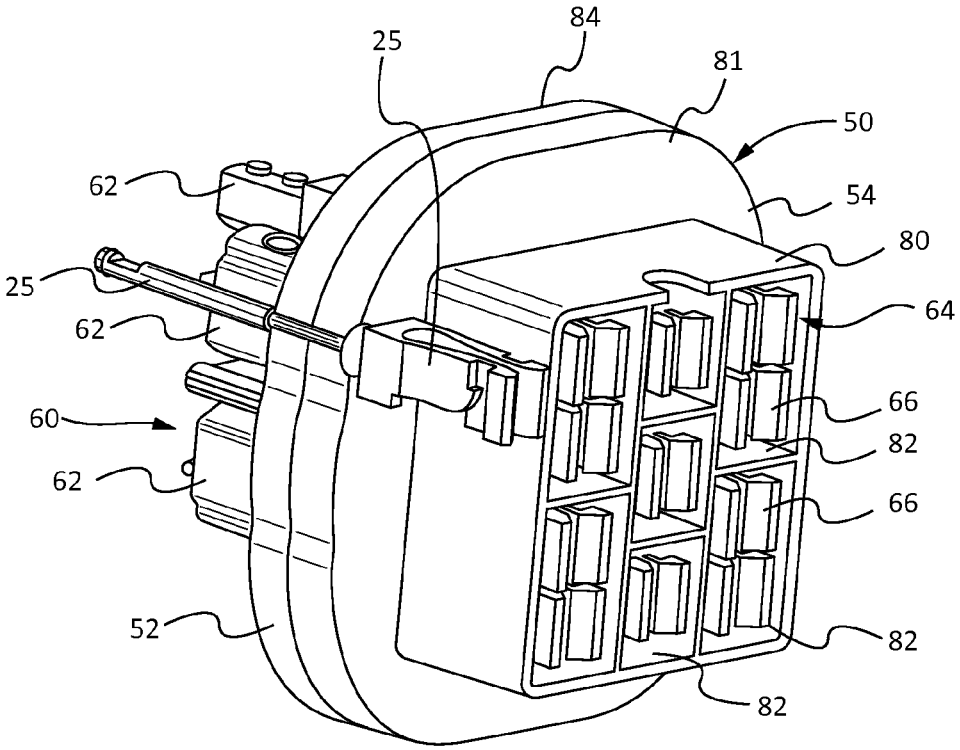
FIG. 6 is a front perspective view of an insulator of the receptacle of FIG. 4 according to one embodiment.

Referring to FIGS. 2 and 3, the insulator 50 of the receptacle 20 electrically insulates the electrical contacts 62, 66 of the internal and external electrical contact interfaces 60, 64, respectively, from each other. Accordingly, the insulator 50 is made from an electrically non-conductive material, such as a polymer or fibrous composite material. The insulator 50 extends from an external side of the electrical device 18 to an internal side of the device. Further, as shown in FIG. 6, the insulator 50 of the receptacle 20 includes two separable portions: (1) an internal portion 52; and (2) an external portion 54. The internal and external portions 52, 54 can be considered two matching or non-matching halves of the insulator 50. In certain implementations, the separable portions 52, 54 of the insulator 50 are separable because they can be easily separated from each other without damaging or destroying the insulator. Further, the separable portions 52, 54 are separable because they are not bonded, adhered, welded, or otherwise permanently fixed to each other. Additionally, in some implementations, the separable portions 52, 54 are separable because they are not coupled together with separate fasteners, such as fasteners that extend through and secure together the separable portions. The separable portions 52, 54 are formed (e.g., manufactured) separately from each other (e.g., in separate manufacturing steps, such as separate molding or machining steps), and each separable portion can form a one-piece monolithic construction.

The housing 22 of the receptacle 20 may include features for securely retaining the insulator 50, including its separable portions, in place during use, but allow for easy removal of the external portion 54 from the housing 22 if desired. In one implementation, the housing 22 includes a recess within which the external portion 54 is positioned and which prevents the external portion 54 (and internal portion 52) from movement away from the electrical device 18 when the housing is secured to the device. The insulator 50 can be sized larger than the aperture 19 formed in the wall 140 of the device 18, such that a portion of the external surface 146 of the wall around the aperture 19 acts as a stop to prevent the internal portion 52 (and external portion 54) from movement toward the electrical device when the housing 22 is secured to the device. In this manner, the portions 52, 54 of the insulator 50 can be firmly secured in place during use.

Figure 8:
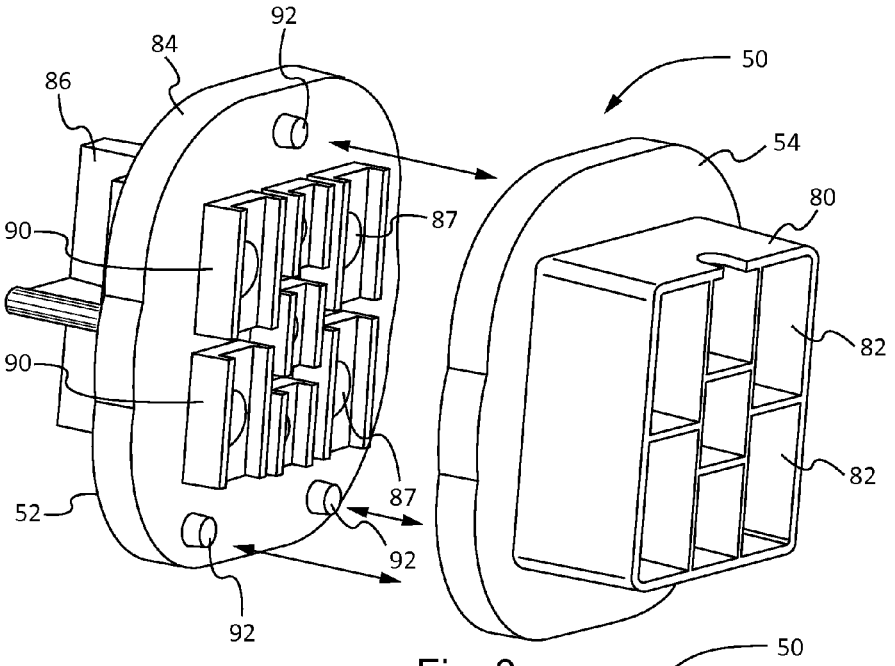
FIG. 8 is a front perspective view of the insulator of FIG. 6 shown with an internal portion separated from an external portion.

Referring to FIGS. 6 and 8, the external portion 54 of the insulator 50 includes a webbing 80 extending from a base 81. The webbing 80 defines a plurality of conduits or apertures 82 within each of which a respective one of the electrical contacts 66 of the external interface 64 is positioned in electrical isolation form the other contacts. In other words, the walls of the webbing 80 create an electrical barrier between the conduits or apertures 82.

Figure 7:
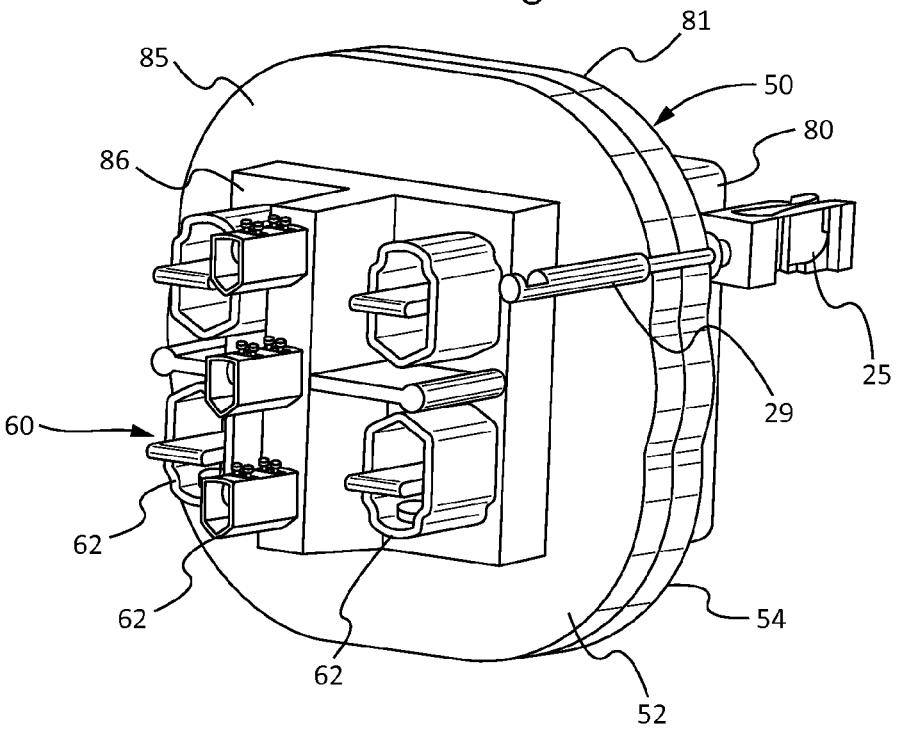
FIG. 7 is a rear perspective view of the insulator of FIG. 6.
Figure 9:
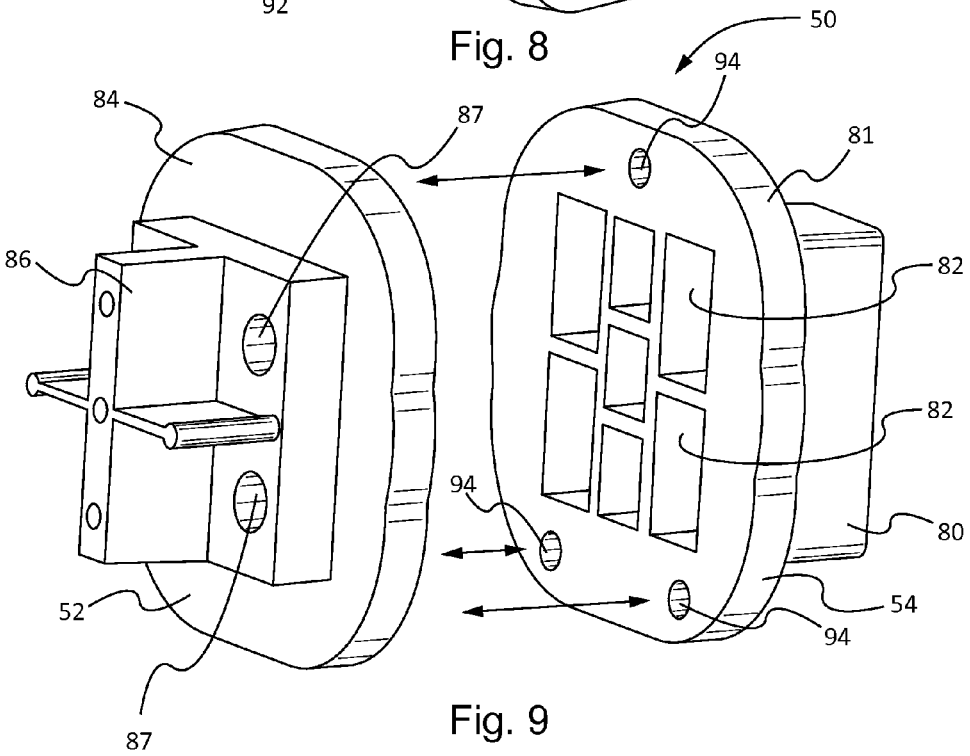
FIG. 9 is a rear perspective view of the insulator of FIG. 6 also shown with the internal portion separated from the external portion.

Similar to the external portion 54 of the insulator 50, as shown in FIGS. 7 and 9, the internal portion 52 of the insulator 50 includes structure 86 coupled to a base 84 (e.g., base plate) for facilitating the electrical isolation of the electrical contacts 62 of the internal interface 60, as well as providing a platform to which the electrical contacts 62, 66 may be secured. The internal portion 52 also includes several apertures 87 that extend through the base 84 and the structure 86. A portion of one or both of the electrical contacts 62, 66 extends through the apertures 87. The outer peripheries of the bases 81, 84 can have the same shape.

As shown in FIG. 6, the bases 84, 81 of the internal and external portions 52, 54 abut or adjoin each other to form the assembled insulator 50. Each of the bases 81, 84 may have a flat surface that mates flush against each other when the portions 52, 54 are coupled together. To ensure proper coupling and alignment, the internal and external portions 52, 54 of the insulator 50 include mating features formed in the flat surfaces. For example, as shown in FIG. 8, the base 84 of the internal portion 52 includes a plurality of alignment features 90 that are sized, shaped, and arranged to engage with (e.g., nestably engage with or be inserted into) respective apertures 82 of the external portion 54. Accordingly, the apertures 82 are larger than the apertures 87 in some implementations. The alignment features 90 engage the apertures 82 to prevent relative rotation of the internal and external portions 52, 54 of the insulator 50. Similarly, the internal portion 52 includes a plurality of protrusions 92 that are sized, shaped, and arranged to engage with (e.g., nestably engage with or be inserted into) corresponding recesses 94 formed in the base 81 of the external portion 54 (see, e.g., FIG. 9). In the illustrated embodiment, the internal and external portions 52, 54 include one protrusion 92 and recess 94 at top sections of the bases 84, 81, respectively, and two protrusions 92 and recesses 94 at bottom sections of the bases 84, 81, respectively. In this manner, the non-symmetrical arrangement of the protrusions 92 and recess 94 ensures that a proper rotational orientation of the internal and external portions 52, 54 relative to each other. In other words, proper engagement between the protrusions and recesses 92, 94 ensures that the top sections of the bases are adjacent each other, and the bottom section of the bases are adjacent each other. It is recognized that in some implementations, the alignment features 90 and protrusions 92 can be formed in the base 81 of the external portion 54, and mating apertures and recesses 94 can be formed in the base 84 of the internal portion 52.

Because the insulator 50 is divided into two easily separable portions, should one portion require replacement (e.g., the external portion 54) due to wear, that portion can be removed without affecting the electrical connections to the other portion. For example, in one embodiment, the housing 22 of the receptacle 20 can be removed by loosening the bolts secured to the posts 142. With the electrical contacts 62, 66 fixedly secured to the internal portion 52 of the insulator 50, the external portion 54 can be pulled away from the internal portion and removed with the internal portion remaining in place. Then, a new or repaired external portion 54 can be recoupled with the existing internal portion 52 and the housing 22 can be secured over the reassembled insulator 50. In this manner, the electrical connections between the electrical device 18 and the electrical contacts 62, 66 remain intact as the external portion 54 is removed and replaced.

Referring to FIGS. 1-3, 10, and 11, the plug 30 includes a housing 32 that at least partially houses an insulator 110. The insulator 110 insulates the electrical contacts 102, 122 of external and internal electrical contact interfaces 100, 120, respectively, of the plug 30. Further, the housing 32 can at least partially house the external electrical contact interface 100. The electrical contacts 122 of the internal electrical contact interface 120 are electrically coupled to respective electrical terminals (not shown) of the cable or wire 16 of another electrical device. Accordingly, in the illustrated embodiment, the electrical contacts 122 are positioned within an internal space defined by the housing 32 between the insulator 110 and the cable 16. The electrical contacts 102 of the external electrical contact interface 122 can be male contacts or include male terminals for being inserted into the female contacts or terminals of the receptacle 20. Alternatively, the electrical contacts 102 of the external electrical contact interface 100 can be female contacts or include female terminals for receiving male contacts or terminals of the receptacle 20.

Each electrical contact 102 of the external interface 100 is electrically coupled to a corresponding one of the electrical contacts 122 of the internal interface 120. In some implementations, electrically coupled external and internal contacts 102, 122 form a single monolithic structure made from an electrically conductive material. In other implementations, electrically coupled external and internal contacts 102, 122 are electrically coupled together by one or more electrically conductive couplings. In this manner, electrical power can be freely transmitted between electrically coupled external and internal contacts 102, 122. Accordingly, when the plug 30 is electrically coupled to the receptacle 20, power from the electrical device 18 (via the electrical contacts 62, 66 of the receptacle 20 and electrical contacts 102 of the plug) is transmitted to the internal electrical contacts 122 and the electrical device electrically coupled to the plug via the cable 16.

The housing 32 of the plug 30 includes a hinge plate 41 secured to a top portion of the housing. The hinge plate 41 includes a channel configured to engage the retention rod 42 of the receptacle 20. Engagement between the hinge plate 41 and retention rode 42 may assist a user with the coupling of the plug 30 to the receptacle 20, and facilitate a proper and secure coupling between the plug and receptacle. In practice, according to one implementation, a user desiring to electrically couple the plug 30 to the receptacle 20 first positions the hinge plate 41 onto the retention rod, such that the channel of the hinge plate receives the retention rod. With the hinge plate 41 engaging the retention rod 42, the plug 30 can be rotated downwardly about the retention rod until the electrical contacts of the plug engage (e.g., are inserted into) the electrical contacts of the receptacle 20, and the pedal 72 releasably latches onto the tab of the plug. Then, to decouple or release the plug 30 from the receptacle 20, the pedal 72 can be engaged to release the tab of the plug, and the plug can be rotated upwardly about the retention rod 42 to remove the electrical contacts of the plug from the electrical contacts of the receptacle. Subsequently, the plug 30 can be lifted to disengage the hinge plate 41 from the retention rod 42.

In certain embodiments, the plug 30 may have an auxiliary ground terminal 34 external to the plug housing 32 (see, e.g., FIG. 1). The auxiliary ground terminal 34 of the plug 30 is configured and positioned to engage (e.g., be inserted into) the auxiliary ground terminal 25 of the receptacle 20. The auxiliary ground terminal 34 may have a corresponding internal electrical contact within the housing 32 of the plug 30.

Figure 10:
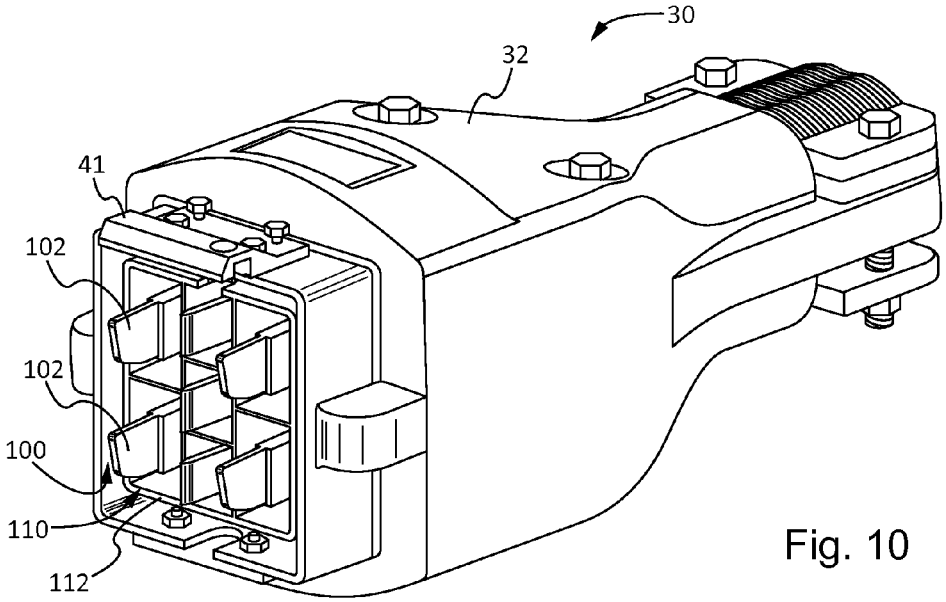
FIG. 10 is a front perspective view of a plug of the plug and receptacle assembly of FIG. 1.
Figure 11:
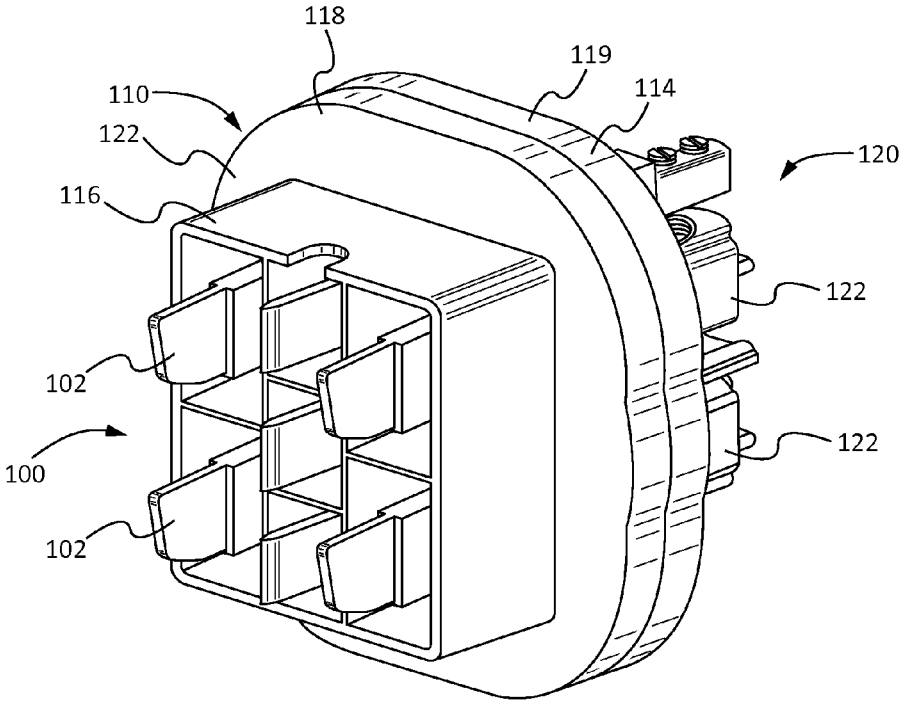
FIG. 11 is a front perspective view of an insulator of the plug of FIG. 10 according to one embodiment.
Figure 12:
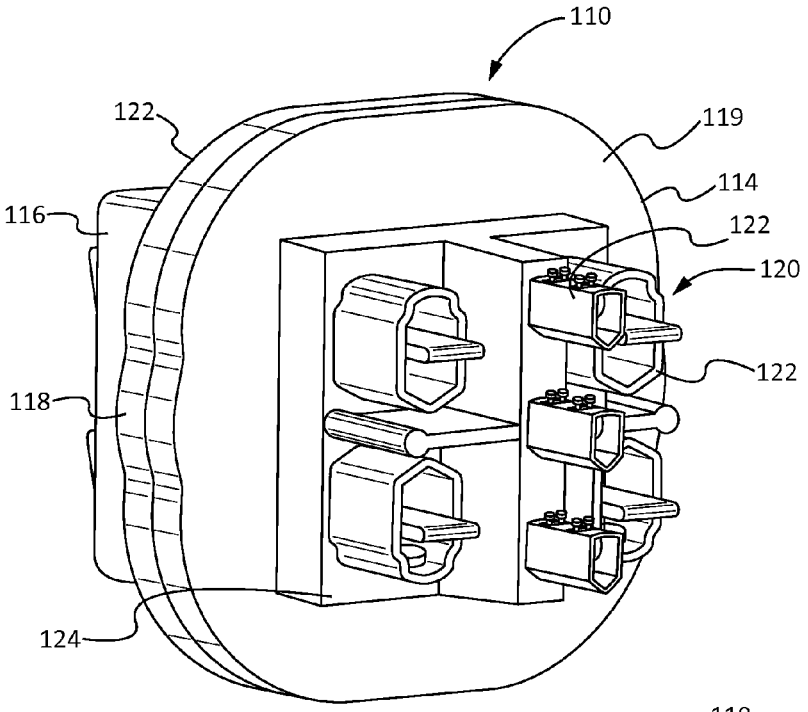
FIG. 12 is a rear perspective view of the insulator of FIG. 11.

Referring to FIGS. 10 and 11, the insulator 110 of the plug 30 electrically insulates the electrical contacts 102, 122 of the external and internal electrical contact interfaces 100, 120, respectively, from each other. Accordingly, the insulator 110 is made from an electrically non-conductive material, such as a polymer or fibrous composite material. The insulator 110 is positioned substantially within the housing 32 of the plug 30.

In some embodiments, the insulator 110 of the plug 30 is configured in a manner similar to the insulator 50 of the receptacle 20. For example, as shown in FIG. 11, the insulator 110 of the plug 30 includes two separable portions: (1) an external portion 112; and (2) an internal portion 114. The external and internal portions 112, 114 can be considered two matching or non-matching halves of the insulator 110. In certain implementations, the separable portions 112, 114 of the insulator 110 are separable because they can be easily separated from each other without damaging or destroying the insulator. The housing 32 of the plug 30 may include features for securely retaining the insulator 110, including its separable portions, in place during use, but allow for easy removal of the external portion 112 from the housing 32 if desired. In one implementation, the housing 32 includes a recess within which the insulator 110 is positioned. The recess can prevent the insulator 110 from movement within the housing 32.

Referring again to FIGS. 10 and 11, the external portion 112 of the insulator 110 includes a webbing 116 extending from a base 118. The webbing 116 defines a plurality of conduits or apertures 130 within each of which a respective one of the electrical contacts 102 of the external interface 100 is positioned in electrical isolation form the other contacts. In other words, the walls of the webbing 116 create an electrical barrier between the conduits or apertures 130.

Figure 14:
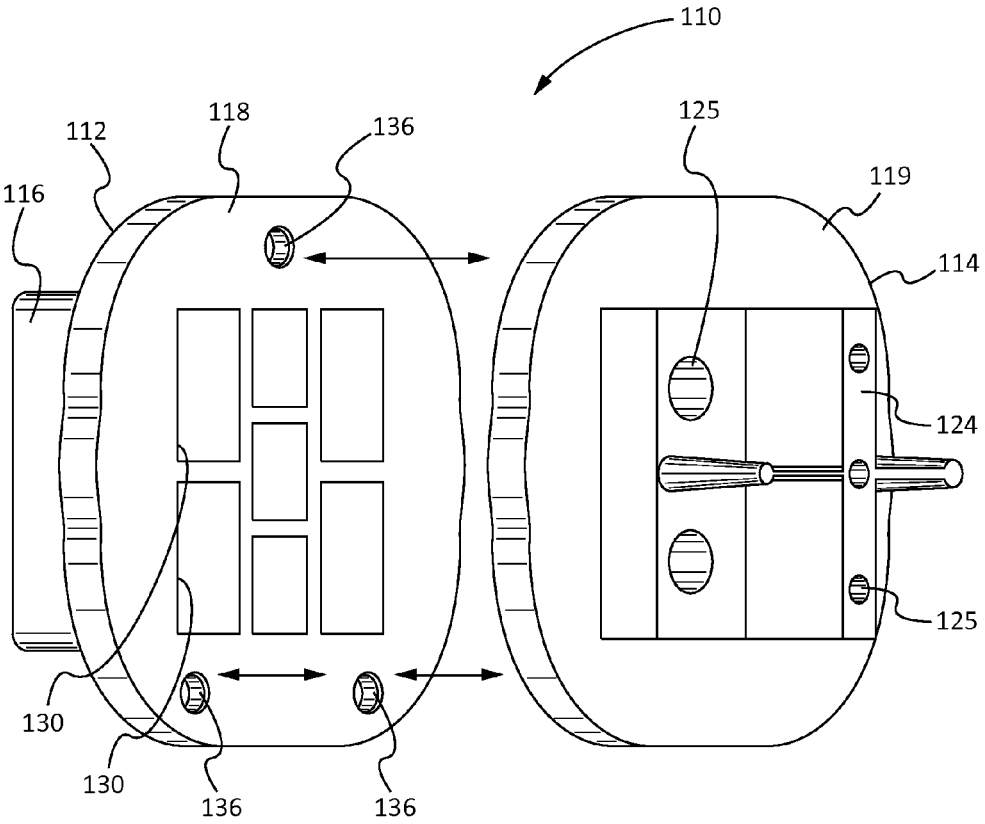
FIG. 14 is a rear perspective view of the insulator of FIG. 11 also shown with the internal portion separated from the external portion.

Similar to the external portion 112 of the insulator 110, as shown in FIG. 14, the internal portion 114 of the insulator 110 includes structure 124 coupled to a base 119 for facilitating the electrical isolation of the electrical contacts 122 of the internal interface 120, as well as providing a platform to which the electrical contacts 102, 122 may be secured. The internal portion 114 also includes several apertures 125 that extend through the base 119 and the structure 124. A portion of one or both of the electrical contacts 102, 122 extend through the apertures 125.

Figure 13:
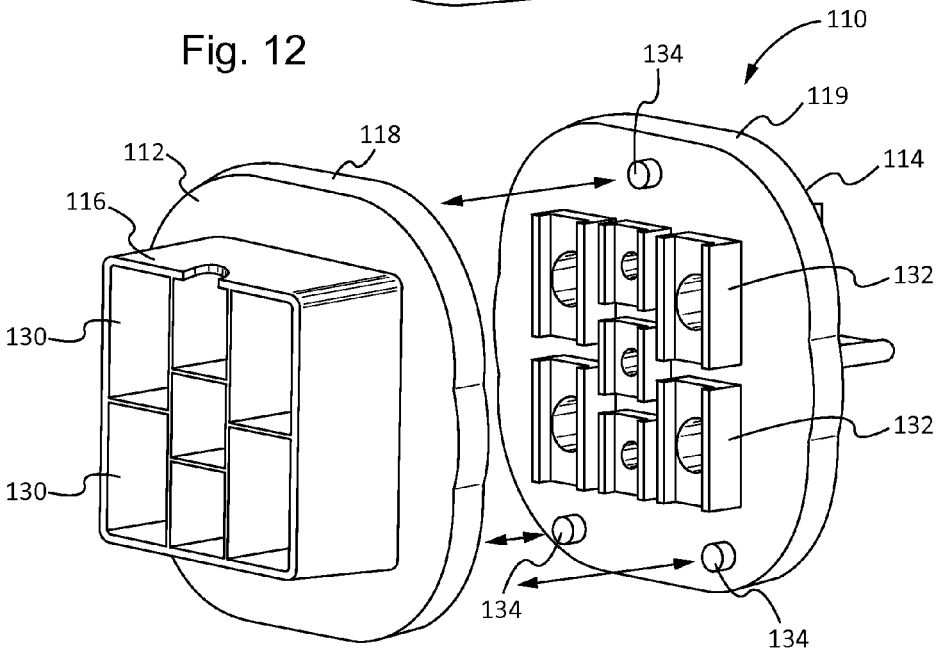
FIG. 13 is a front perspective view of the insulator of FIG. 11 shown with an internal portion separated from an external portion.

As shown in FIG. 11, the bases 118, 119 of the external and internal portions 112, 114 abut or adjoin each other to form the assembled insulator 110. Each of the bases 118, 119 may have a flat surface that mates flush against each other when the portions 112, 114 are coupled together. To ensure proper coupling and alignment, the external and internal portions 112, 114 of the insulator 110 include mating features formed in the flat surfaces. For example, as shown in FIG. 13, the base 119 of the internal portion 114 includes a plurality of alignment features 132 that are sized, shaped, and arranged to engage with (e.g., nestably engage with or be inserted into) respective apertures 130 of the external portion 112. The alignment features 132 engage the apertures 130 to prevent relative rotation of the external and internal portions 112, 114 of the insulator 110. Similarly, the internal portion 114 includes a plurality of protrusions 134 that are sized, shaped, and arranged to engage with (e.g., nestably engage with or be inserted into) corresponding recesses 136 formed in the base 118 of the external portion 112 (see, e.g., FIG. 14). In the illustrated embodiment, the external and internal portions 112, 114 include one recess 136 and protrusion 134 at top sections of the bases 118, 119, respectively, and two recesses and protrusions at bottom sections of the bases, respectively. In this manner, the non-symmetrical arrangement of the protrusions 134 and recess 136 ensures that a proper rotational orientation of the external and internal portions 112, 114 relative to each other. In other words, proper engagement between the protrusions and recesses 134, 136 ensures that the top sections of the bases are adjacent each other, and the bottom section of the bases are adjacent each other. It is recognized that in some implementations, the alignment features 132 and protrusions 134 can be formed in the base 118 of the external portion 112, and mating apertures and recesses 136 can be formed in the base 119 of the internal portion 114.

Because the insulator 110 is divided into two easily separable portions, should one portion require replacement (e.g., the external portion 112) due to wear, that portion can be removed without affecting the electrical connections to the other portion. For example, in one embodiment, the housing 32 of the receptacle 30 can be removed by separating two halves of the housing secured together by fasteners. With the electrical contacts 102, 122 fixedly secured to the internal portion 114 of the insulator 110, the external portion 112 can be pulled away from the internal portion and removed with the internal portion remaining in place. Then, a new or repaired external portion 112 can be recoupled with the existing internal portion 114 and the housing 32 can be reassembled to retain the reassembled insulator 110 within the housing. In this manner, the electrical connections between the cable 16 of an electrical device electrically coupled to the plug via the cable, and the electrical contacts 102, 122 remain intact as the external portion 112 is removed and replaced.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An assembly, comprising at least one of:

a plug comprising a first electrical insulator isolating a plurality of first electrical contacts, the first electrical insulator comprising two separable halves, the plug further comprising a first housing within which the first electrical insulator is housed; or a receptacle comprising a second electrical insulator isolating a plurality of second electrical contacts, the second electrical insulator comprising two separable halves, the receptacle further comprising a second housing within which the second electrical insulator is housed;

wherein the plurality of first electrical contacts are engageable with the plurality of second electrical contacts to electrically couple the plug and receptacle;

wherein each of the separable halves of the first electrical insulator comprises a plurality of apertures, each aperture of one half of the first electrical insulator is aligned with the other half of the first electrical insulator to define a first through-channel in the first electrical insulator, wherein each of the plurality of first electrical contacts is positioned within a respective one of the first through-channels and extends through both halves of the first electrical insulator; and wherein each of the separable halves of the second electrical insulator comprises a plurality of apertures, each aperture of one half of the second electrical insulator is aligned with the other half of the second electrical insulator to define a second through-channel in the second electrical insulator, wherein each of the plurality of second electrical contacts is positioned within a respective one of the second through-channels and extends through both halves of the second electrical insulator.

2. The assembly of claim 1, wherein the assembly comprises both the plug and the receptacle.

3. The assembly of claim 1, wherein the receptacle is electrically coupled to a power generating device and receives power from the power generating device, and wherein the power is rated at 1,000 V or lower.

4. The assembly of claim 1, wherein:

each of the plurality of first electrical contacts extends entirely through both halves of the first electrical insulator; and each of the plurality of second electrical contacts extends entirely through both halves of the second electrical insulator.

5. The assembly of claim 4, wherein at least one of:

a first of the separable halves of the first electrical insulator comprises a plurality of first alignment features each positioned about a respective one of the plurality of apertures of the first separable half of the first electrical insulator, the plurality of first alignment features each being received within a respective one of the plurality of apertures of a second separable half of the first electrical insulator; and a first of the separable halves of the second electrical insulator comprises a plurality of second alignment features each positioned about a respective one of the plurality of apertures of the first separable half of the second electrical insulator, the plurality of second alignment features each being received within a respective one of the plurality of apertures of a second separable half of the second electrical insulator.

6. The assembly of claim 5, wherein:

each of the plurality of first alignment features nestably engages a respective one of the plurality of apertures of the second separable half of the first electrical insulator; and each of the plurality of second alignment features nestably engages a respective one of the plurality of apertures of the second separable half of the second electrical insulator.

7. The assembly of claim 4, wherein:

the plurality of apertures of a first of the separable halves of the first electrical insulator are larger than the plurality of apertures of a second of the separable halves of the first electrical insulator; and the plurality of apertures of a first of the separable halves of the second electrical insulator are larger than the plurality of apertures of a second of the separable halves of the second electrical insulator.

8. The assembly of claim 1, wherein:

a first of the separable halves of the first electrical insulator comprises a plurality of first protrusions and a second of the separable halves of the first electrical insulator comprises a plurality of first recesses, the plurality of first protrusions each being received within a respective one of the plurality of first recesses; and a first of the separable halves of the second electrical insulator comprises a plurality of second protrusions and a second of the separable halves of the second electrical insulator comprises a plurality of second recesses, the plurality of second protrusions each being received within a respective one of the plurality of second recesses.

9. The assembly of claim 1, wherein:

the two separable halves of the first electrical insulator are rotatably fixed relative to each other; and the two separable halves of the second electrical insulator are rotatably fixed relative to each other.

10. The assembly of claim 1, wherein:

each of the two separable halves of the first electrical insulator comprises a base plate having a flat surface, wherein the flat surfaces of the base plate of the first electrical insulator abut and are flush against each other; and each of the two separable halves of the second electrical insulator comprises a base plate having a flat surface, wherein the flat surfaces of the base plate of the second electrical insulator abut and are flush against each other.

11. The assembly of claim 1, wherein:

a first half of the separable halves of the first electrical insulator is an interior half not accessible by the receptacle and the second half of the separable halves of the first electrical insulator is an exterior half accessible by the receptacle, interior portions of the plurality of first electrical contacts being electrically wired via wiring to a power cord extending from the plug, and wherein the exterior half of the first electrical insulator is replaceable by another exterior half without replacing the interior half of the first electrical insulator, and without having to disconnect the wiring from the interior portions of the plurality of first electrical contacts; and a first half of the separable halves of the second electrical insulator is an interior half not accessible by the plug and the second half of the separable halves of the second electrical insulator is an exterior half accessible by the plug, interior portions of the plurality of second electrical contacts being electrically wired via wiring to a power center to which the receptacle is coupled, and wherein the exterior half of the second electrical insulator is replaceable by another exterior half without replacing the interior half of the second electrical insulator, without having to disconnect the wiring from the interior portions of the plurality of first electrical contacts, and without having to decouple the receptacle from the power center.

12. The assembly of claim 1, wherein the receptacle comprises a cover that is rotatable about a retention rod coupled to the plug, the cover being rotatable between a closed position covering the plurality of electrical contacts and an open position exposing the plurality of electrical contacts, and wherein the plug comprises a hinge plate that engages and rotates about the retention rod.

13. The assembly of claim 1, wherein:

the two separable halves of the first electrical insulator are formed separately from each other and each form a one-piece monolithic construction; and the two separable halves of the second electrical insulator are formed separately from each other and each form a one-piece monolithic construction.

* * * * *